United States Patent [19]

Churley et al.

[11] 4,229,229

[45] Oct. 21, 1980

[54] WAREWASHER SANITIZER VENTED METERING SYSTEM

[75] Inventors: George Churley; Louis F. Fraula, both of Troy, Ohio

[73] Assignee: Hobart Corporation, Troy, Ohio

[21] Appl. No.: 40,256

[22] Filed: May 18, 1979

[51] Int. Cl.[3] ..... B08B 7/04

[52] U.S. Cl. ..... 134/18; 134/25.2; 134/95; 134/102; 239/340; 222/630

[58] Field of Search ..... 134/18, 36, 102, 101, 134/100, 95, 94, 58 D, 25 A, 25 R; 68/17 R; 222/630, 129.2, 70; 239/347, 337, 340, 369, 70

[56] References Cited

U.S. PATENT DOCUMENTS

| | | | |
|---|---|---|---|
| 2,511,637 | 6/1950 | Johannes | 222/70 |
| 2,968,071 | 1/1961 | Di Perna | 239/369 |
| 3,373,905 | 3/1968 | Laufer, Sr. | 222/630 |

*Primary Examiner*—S. Leon Bashore
*Assistant Examiner*—Michael Goldman
*Attorney, Agent, or Firm*—Biebel, French & Nauman

[57] ABSTRACT

A liquid sanitizing agent is drawn into a capillary conduit section of defined volume, then separated from the supply thereof by opening an atmospheric back pressure vent at the lower end of the capillary section at substantially the same time said capillary section is filled. The sanitizing agent in the capillary section is then pumped as a liquid plug of defined volume into the sanitizing system of the warewasher.

7 Claims, 2 Drawing Figures

WAREWASHER SANITIZER VENTED METERING SYSTEM

BACKGROUND OF THE INVENTION

This invention relates to warewashers, such as dishwashing machines, and more particularly to a vented metering system for reliably and consistently dispensing a precisely determined quantity of liquid sanitizing agent independently of ambient conditions.

Warewashers having sanitizing systems for chemically sanitizing foodware items are known in the prior art. A particularly effective system, which utilizes air transport for reliably delivering a liquid sanitizing agent with a minimum of servicing and maintenance requirements is shown in U.S. Application Ser. No. 835,197, filed Sept. 21, 1977, Ser. No. 788,039, filed Apr. 15, 1977, Ser. No. 835, 198, filed Sept. 21, 1977, and Ser. No. 875,868, filed Feb. 7, 1978, all assigned to the assignee of the present application.

However, due to changes in external conditions, such as supply voltages, pressures, ambient atmospheric conditions, and so on, the above dispensers can be subject to fluctuations and variations in the amount of liquid sanitizing agent which is delivered. That is, since air is a compressible fluid, changes in barometric pressure, ambient temperature, humidity, altitude, the level of sanitizing agent in the supply bottle, compressor speed (due to voltage fluctuations), valve leakage in the air compressor, and so on, can all contribute to inconsistencies in the performance of air driven aspirators. In going from sea level to an altitude of approximately 10,000 ft., for example, the amount of liquid sanitizing agent delivered by the systems described in the above applications could be expected to be reduced by as much as 50%.

Of course, variations in the rate and the amount of sanitizing agent which is delivered have long been recognized as problems in chemical sanitizing machines, regardless of the mechanism by which the sanitizing agent is delivered. With water driven venturis, not only were deposits of minerals in the venturi a source of continuing trouble, but variations in line pressure and atmospheric conditions usually caused variations in the quantity of sanitizer which was delivered.

There is thus a need for a system which effectively and reliably delivers a predetermined quantity of liquid sanitizing agent each time the system is cycled. The system should be durable, easily maintained, uncomplicated, inexpensive, and suited for use in a wide variety of applications.

SUMMARY OF THE INVENTION

Briefly, the present invention provides a vented metering system which first prepares a precisely measured quantity or volume of the liquid sanitizing agent and then delivers it into the sanitizing system. This is accomplished by providing a capillary section of defined volume in the conduit which connects the sanitizing agent supply to the sanitizing system dispenser. As used herein, the term "capillary section" is not meant to refer to capillary action, but to the other meaning of "capillary": "having a very small bore". Specifically, the term is used herein to refer to a length or section of conduit having an internal size small enough that the surface tension of the liquid sanitizing agent therein will hold a meniscus at both ends of a discrete column of sanitizing agent located within the section. Depending upon the properties of the materials used and the operating parameters, this section can have a rather generous internal size (typically 4.8 mm I.D. or larger). Expressed another way, the term "capillary section" means that if a small quantity of the liquid sanitizing agent is drawn into the section, with air above and below it, it will tend to remain integrated and united due to the surface tension on the menisci at the ends thereof. The tubing can therefore be as large or small as desired, as long as the liquid remains integrated. This makes it possible to pump that particular quantity of liquid sanitizing agent through the capillary conduit section substantially as a discrete liquid plug.

In practice, dispensers such as disclosed in the above-noted U.S. patent applications have employed a conduit formed of plastic tubing having an internal cross-sectional diameter of 4.8 mm, and a length of this has served quite satisfactorily as a "capillary section" for use with the present invention.

The capillary section is therefore but a particular portion of the conduit, selected to have an internal volume precisely equal to the volume of liquid sanitizing agent which is to be dispensed on each cycle. The upstream end of the capillary section closest to the liquid sanitizing agent supply is above the supply. When the dispenser is actuated, the liquid sanitizing agent (preferably a 5.2% solution of sodium hypochlorite) is pumped into and through the conduit and the capillary section thereof, filling the capillary section with a volume of sanitizing agent which is equal to the volume of the capillary section. When the capillary section is full, the volume of sanitizing agent therein is then separated from the remainder of the agent in the conduit so that the precise volume of sanitizing agent in the capillary section can be pumped as a liquid plug of defined volume into the sanitizing system.

An atmospheric back pressure vent separates the defined volume of sanitizing agent in the capillary section from the remainder of the agent in both the conduit and the sanitizing agent supply. The atmospheric back pressure vent is simply a small solenoid valve which is connected by a tee into the conduit at the lower end of the capillary section. The solenoid valve is normally closed, and opens to the atmosphere when energized. Such valves are well-known in the prior art.

When operation of the dispenser is commenced, the solenoid valve is not energized and remains closed. When the capillary section is filled with the sanitizing agent solution, the solenoid valve is energized. This opens the solenoid valve atmospheric back pressure vent which, with the tee, relieves the vacuum in the line at that point. The agent in the capillary section is above the atmospheric back pressure vent and continues to be pumped into the sanitizing system dispenser. That which is below the atmospheric back pressure vent is pumped no further, and may fall and return back through the conduit therebelow into the sanitizing agent supply.

Only air flows through the solenoid valve. Since no sodium hypochlorite solution flows through the valve, no corrosion problems will be experienced. The present invention can therefore be used with small, inexpensive air solenoid valves while enjoying high reliability. Exactly the right quantity of liquid sanitizing agent is delivered each and every time, substantially unaffected by changes in ambient conditions.

It is therefore an object of the present invention to provide a vented metering system for a warewasher having a chemical sanitizing system for sanitizing food ware items therein; a vented metering system having a capillary section of defined volume with an atmospheric back pressure vent at the upstream end thereof; wherein the atmospheric back pressure vent is held closed when operation of the sanitizing system is commenced and until the liquid sanitizing agent has reached the downstream end of the capillary section; wherein the atmospheric back pressure vent is then opened to separate the liquid sanitizing agent in the capillary section from the supply thereof for pumping the sanitizing agent into the sanitizing system as a discrete plug of defined volume; and to accomplish the above objects and purposes in an inexpensive, reliable and durable configuration which reliably dispenses defined volumes of the liquid sanitizing agent independently of variations in ambient conditions, and is readily suited for use in a wide variety of sanitizer delivery systems for chemically sanitizing warewasher systems.

Other objects and advantages of the invention will be apparent from the following description, the accompanying drawings and the appended claims.

DESCRIPTION OF THE PREFERRED EMBODIMENTS

Figure 1:
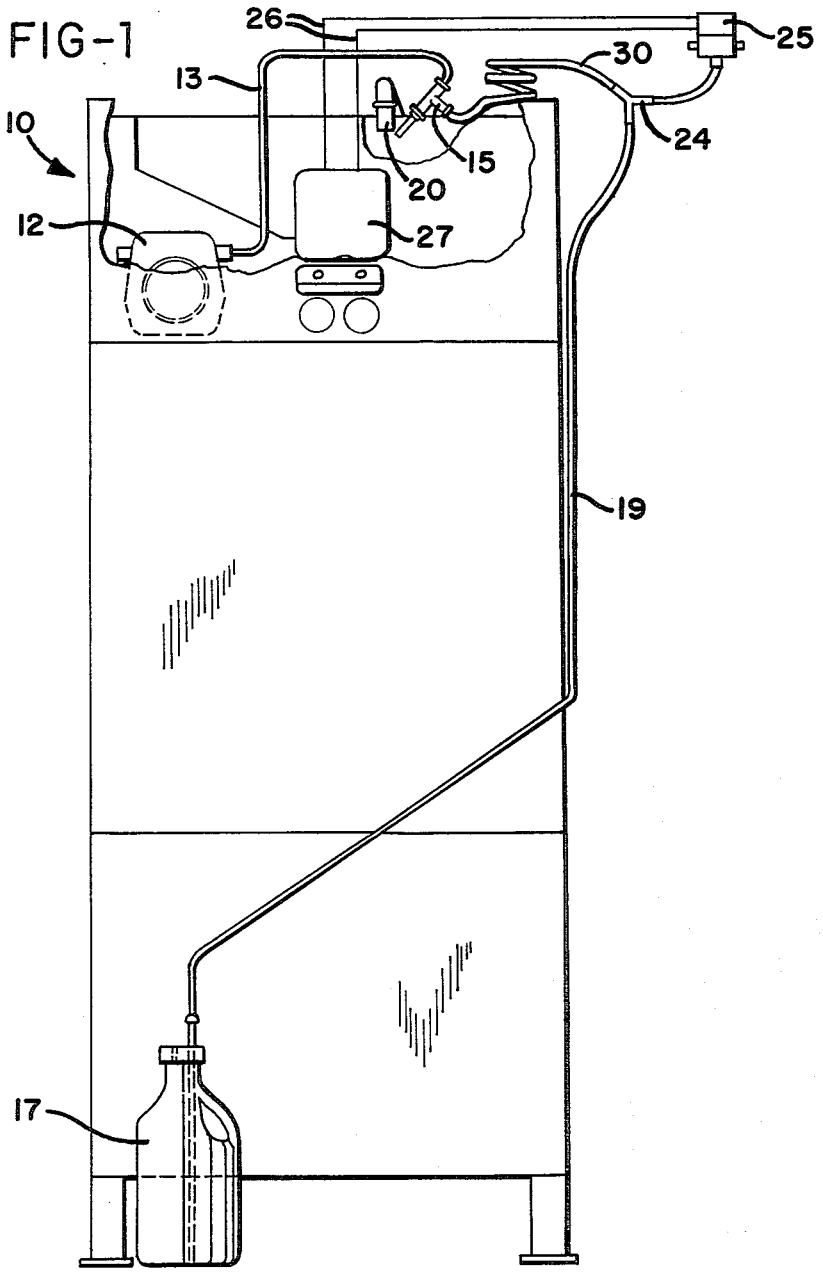
FIG. 1 is a somewhat diagrammatic front view of a warewasher equipped with a vented metering system according to the present invention.

FIG. 1 illustrates a warewasher 10 having a sanitizing system for chemically sanitizing foodware items therein. As indicated earlier, the above-noted U.S. patent applications more particularly describe the sanitizing system which is generally shown here, and these disclosures are therefore incorporated herein by reference.

The sanitizing system which is illustrated includes an air compressor 12 which is connected by a suitable air conduit 13 to an air driven aspirator 15 which aspirates liquid sanitizing agent from a vented supply 17 thereof through a conduit 19 which connects the supply 17 to aspirator 15. The aspirator then injects the liquid sanitizing agent into warewasher 10 beneath the outlet 20 of the fresh water supply, as shown more particularly in the above-noted U.S. application Ser. No. 835,197. Thus, compressor 12, conduit 13, aspirator 15, supply 17, and conduit 19 form a dispenser which is operable upon actuation of air compressor 12 to controllably pump the liquid sanitizing agent from supply 17 into the remainder of the sanitizing system within the warewasher 10.

In accordance with the present invention, a tee 24 and normally closed solenoid valve 25 are located in conduit 19. Solenoid valve 25 is connected by a wire pair 26 to a control circuit 27 for controlling the dispenser. Control circuit 27 includes a conventional timing circuit (not shown) which is connected for operating solenoid valve 25, which, when energized, is vented to the atmosphere.

Aspirator 15 is located at the downstream end of a section 30 of conduit 19, and tee 24 is located at the upstream end. Section 30 has a predetermined, defined volume and is the capillary section of the conduit. In this embodiment, when 5.2% sodium hypochlorite solution is used, section 30 has an internal cross-sectional diameter of 4.8 ml, is 14 cm long, and has an internal volume of about 10 to 13 ml. As can be seen, tee 24 and valve 25 thus serve as an atmospheric back pressure vent at the upstream end of the capillary section 30.

In operation, the air compressor 12 and air driven aspirator 15 serve as a pump which aspirates and pumps the liquid sanitizing agent from the supply 17 into the sanitizing system. When a charge of sanitizing agent is to be dispensed, compressor 12 is actuated and the timer in control circuit 27 is started. Solenoid valve 25 is not energized and remains closed during an initial period, for example three seconds, during which the capillary section is filled with the liquid sanitizing agent. During this time interval the timer holds the atmospheric back pressure vent closed, and thereafter energizes the solenoid, thereby separating the agent in the capillary section 30 from the remainder of the agent in conduit 19. At this point the capillary section 30 is filled with a defined volume of the liquid sanitizing agent, which may then be pumped as a liquid plug of defined volume into the sanitizing system by continued operation of air compressor 12.

When the timer in control circuit 27 is properly adjusted, it will consistently energize and open the atmospheric back pressure vent at substantially the same time the capillary section 30 is filled, regardless of atmospheric conditions. In a typical cycle, solenoid 25 will be energized three seconds after air compressor 12 is started, as indicated above. The complete cycle time for operating compressor 12 to dispense the sanitizing agent is 15 seconds, the balance of time being for aspirating and injecting the measured plug or charge of liquid sanitizing agent through aspirator 15 from capillary section 30, and into the warewasher sanitizing system. There is excess compressor time in this cycle to assure full dispensing of the measured quantity of sanitizing agent in spite of system variations or fluctuations in ambient conditions, the average time actually necessary for pumping the measured quantity of sanitizing agent out of capillary section 30 being on the order of 10 seconds.

As may be seen, very little time is required for filling the capillary section. This is so because during this interval the aspirator is aspirating air, which flows very quickly. Once the liquid sanitizing agent reaches the aspirator, the flow in conduit 19 is greatly retarded. Therefore, the time for filling the capillary section is but a small part of the dispensing cycle, and will be substantially constant within the framework of the overall machine operating cycle, regardless of atmospheric conditions. Even if the fill interval is a little longer than might be necessary (to provide additional confidence that the capillary section will be filled) little excess sanitizing agent will be dispensed since its flow rate will be markedly reduced as soon as it reaches the aspirator and is slowed in the orifice throat of the venturi.

The cycle time which follows, that is, the time for aspirating the liquid, is the time interval during which ambient variations took their toll in prior art configurations. By pre-measuring the sanitizing agent in the capillary section 30 before it is pumped through aspirator 15, the present invention eliminates the influence and importance of these variations in ambient conditions.

When properly adjusted, therefore, the present invention will energize the solenoid valve 25 and open the atmospheric back pressure vent at substantially the same time that the capillary section is filled. The timer in the control circuit 27 is therefore a means for assuring that the capillary section 30 will be filled, and for opening it at substantially the same time that it is filled.

Figure 2:
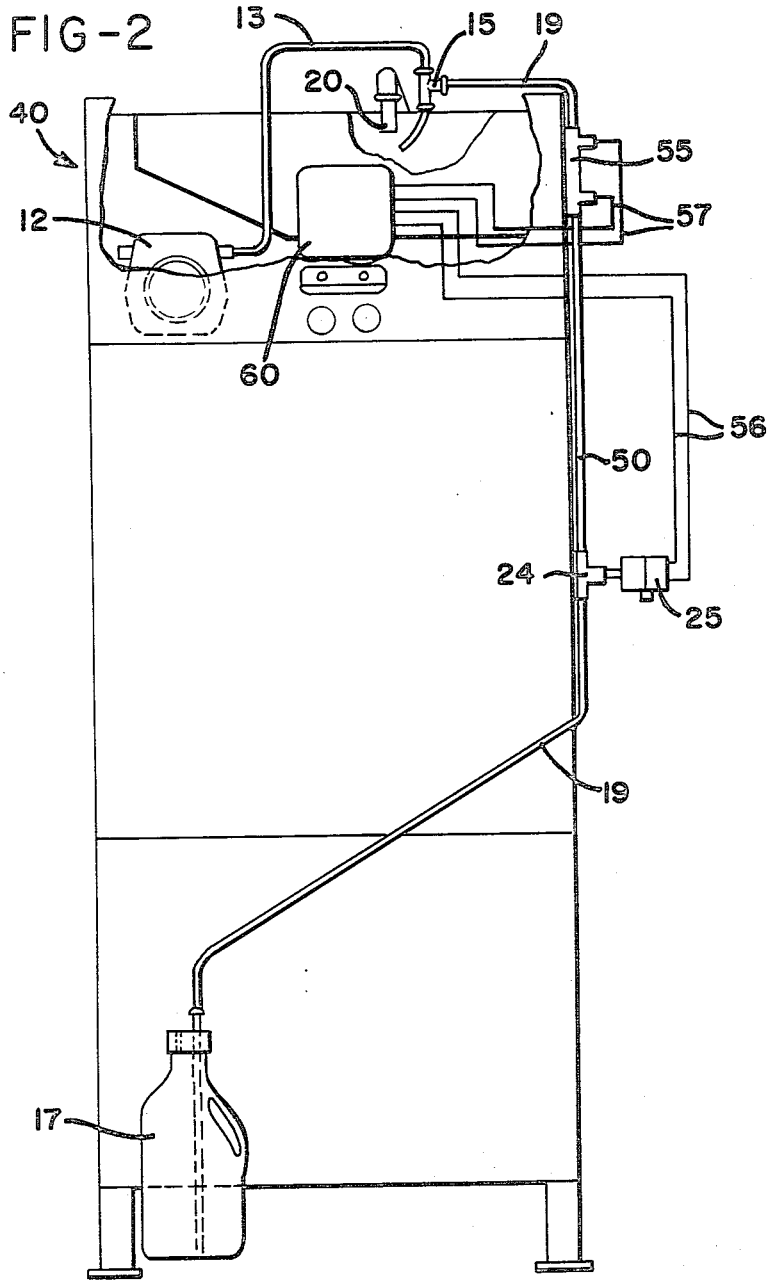
FIG. 2 is an illustration similar to FIG. 1 of the preferred embodiment of the invention.

Upon reading this disclosure, other means will occur to those skilled in the art for assuring that the capillary section 30 has been filled and for thereafter energizing the solenoid valve 25 to open the atmospheric back pressure vent. For example, the warewasher 40 shown in FIG. 2 is provided with the presently preferred vented metering system embodiment. Like numbers are used on those components in warewasher 40 which correspond to those in warewasher 10 (FIG. 1) for ease of comparison. Thus, as in warewasher 10, a tee 24 is located at the bottom or upstream end of a capillary section 50 of the liquid sanitizing agent conduit 19. Capillary section 50 has the same overall dimensions as that of section 30 except that it is straight rather than coiled, and the liquid sanitizing agent therein is pumped upwardly rather than downwardly. As in warewasher 10, tee 24 is connected to and communicates with a solenoid valve 25 which is normally closed, and when energized is vented to the atmosphere to provide an atmospheric back pressure vent at the lower or upstream end of capillary section 50. A suitable detector 55 is located at the upper or downstream end of capillary section 50.

Solenoid valve 25 (FIG. 2) and detector 55 are connected by respective wire pairs 56 and 57 to a control circuit 60. A suitable detector 55 and control circuit 60 which may be used are disclosed in greater detail in the above-noted U.S. patent application Ser. No. 835,198. When control circuit 60 detects completion of the circuit between the probes in detector 55, circuit 60 actuates solenoid valve 25 to vent the conduit to the atmosphere at tee 24. This separates the sanitizing agent in the capillary section 50 from the remainder of the agent therebelow in conduit 19. The warewasher control circuitry (also more fully described in the above-noted applications) continues to operate compressor 12 for a sufficient time thereafter to aspirate the defined volume of sanitizing agent through capillary section 50 into and through aspirator 15, so that the defined volume of liquid sanitizing agent is pumped as a liquid plug into the sanitizing system.

As may be seen, therefore, the present invention provides numerous advantages. It is inexpensive, durable and reliable. It is readily suited for use in dispensing precisely measured quantities of liquid sanitizing agents in a wide variety of warewasher applications, including those using mechanical or water driven pumps or venturis for controllably pumping liquid sanitizing agents into the sanitizing system. In the preferred embodiment, an air driven aspirator is used, and therefore no mechanical or moving parts are exposed to the corrosive effects of the liquid sanitizing agent. The air compressor 12 and atmospheric back pressure air vent solenoid valve 25 never come into contact with the liquid sanitizing agent. Since the internal volume of the capillary sections 30 and 50 is substantially unaffected by ambient conditions, the volume of liquid sanitizing agent which is dispensed in each cycle of the sanitizing system is likewise unaffected by changes in these conditions. The present invention, by appropriately sizing section 30 or 50, is readily and inexpensively adjusted for delivering the precisely defined volume of agent which is needed for the particular application at hand.

While the forms of apparatus herein described constitute preferred embodiments of this invention, it is to be understood that the invention is not limited thereto, and that changes may be made therein without departing from the scope of the invention.

What is claimed is:

1. In combination with a warewasher such as a dishwashing machine having a sanitizing system for chemically sanitizing foodware items therein, including a dispenser which is operable for controllably delivering a liquid sanitizing agent from a supply thereof into the sanitizing system, a vented metering system comprising:

(a) a conduit connecting the supply of the liquid sanitizing agent to the dispenser, (b) means in said conduit forming a capillary section of defined volume, the upstream end of said capillary section being closest to the liquid sanitizing agent supply and above the supply, (c) filling means for filling said capillary section with the liquid sanitizing agent, (d) an atmospheric back pressure vent at the upstream end of said capillary section, (e) holding and opening means for holding said atmospheric back pressure vent closed when said filling means is operated and until said capillary section is filled with the liquid sanitizing agent, and then opening said vent at substantially the same time that said capillary section is filled regardless of atmospheric conditions to separate the agent in said capillary section from the remainder of the agent in said conduit and provide a liquid plug of sanitizing agent of defined volume which is delivered into the sanitizing system.

2. The structure of claim 1 wherein said holding and opening means further comprises a timer for assuring that said capillary section is filled before said atmospheric back pressure vent is opened, said timer being connected for first operating said filling means for a predetermined time interval and holding said atmospheric back pressure vent closed during said timer interval, and then opening said vent, said timer interval being sufficient to fill said capillary section regardless of atmospheric conditions.

3. The structure of claim 1 wherein said filling means further comprises a pump connected to said conduit and forming part of the dispenser.

4. The structure of claim 3 wherein said pump comprises an air compressor and an air driven aspirator operably connected for aspirating and pumping the liquid sanitizing agent from the supply thereof through said conduit into the sanitizing system.

5. In combination with a warewasher such as a dishwashing machine having a sanitizing system for chemically sanitizing foodware items therein, including a dispenser which is operable for controllably pumping a liquid sanitizing agent from a supply thereof into the sanitizing system, a vented metering system comprising:

(a) a conduit connecting the supply of the liquid sanitizing agent to the dispenser, (b) means in said conduit forming a capillary section of defined volume, the upstream end of said capillary section being closest to the liquid sanitizing agent supply and above the supply;

(c) an air compressor and an air driven aspirator operably connected for filling said capillary section with the liquid sanitizing agent from the supply thereof and then pumping the liquid sanitizing agent from said capillary section into the sanitizing system, (d) an atmospheric back pressure vent at the upstream end of said capillary section;

(e) timer means connected for first operating said air compressor and aspirator for a predetermined time interval and for holding said atmospheric back pressure vent closed during said time interval and until said capillary section is filled with the liquid sanitizing agent, said time interval being of a duration just long enough to fill said capillary section regardless of atmospheric conditions for assuring that said capillary section is filled, and then, at the end of said time interval, opening said atmospheric back pressure vent at substantially the same time that said capillary section is filled, the agent in said capillary section then being separated from the remainder of the agent in said conduit, and (f) means for operating said air compressor and aspirator to pump the sanitizing agent in said capillary section as a liquid plug of defined volume into the sanitizing system.

6. A method for injecting a measured quantity of a liquid sanitizing agent into the sanitizing system of a warewasher such as a dishwashing machine having a sanitizing system for chemically sanitizing foodware items therein, including a dispenser which is operable for controllably delivering a liquid sanitizing agent from a supply thereof into the sanitizing system, comprising:

(a) filling a capillary conduit section of defined volume with a liquid sanitizing agent drawn upwardly from a supply thereof, (b) then venting the upstream end of said capillary section to atmosphere to separate the agent in the capillary section from that in the supply and provide a liquid plug of defined volume which is delivered into the sanitizing system wherein said venting occurs after the sanitizing agent is delivered into the capillary section from said supply for a predetermined time which is just long enough to fill the capillary section regardless of atmospheric conditions.

7. The method of claim 6 wherein said filling step is performed by aspirating the liquid sanitizing agent with an air driven aspirator.

* * * * *